US010745167B1

(12) United States Patent
Panosian et al.

(10) Patent No.: US 10,745,167 B1
(45) Date of Patent: Aug. 18, 2020

(54) CUT-CASE WITH ENHANCED DISPLAY OF PRODUCT INFORMATION

(71) Applicant: TOUGHBUILT INDUSTRIES, INC., Lake Forest, CA (US)

(72) Inventors: Michael H. Panosian, Irvine, CA (US); Joshua Keeler, Lake Forest, CA (US)

(73) Assignee: Toughbuilt Industries, Inc., Lake Forest, CA (US)

( * ) Notice: Subject to any disclaimer, the term of this patent is extended or adjusted under 35 U.S.C. 154(b) by 0 days.

(21) Appl. No.: 16/669,010

(22) Filed: Oct. 30, 2019

Related U.S. Application Data

(60) Provisional application No. 62/890,299, filed on Aug. 22, 2019.

(51) Int. Cl.
*B65D 5/22* (2006.01)
*B65D 5/42* (2006.01)
*B65D 5/54* (2006.01)

(52) U.S. Cl.
CPC ..... *B65D 5/422* (2013.01); *B65D 5/542* (2013.01)

(58) Field of Classification Search
CPC .. B65D 5/5226; B65D 5/5233; B65D 5/5246; B65D 5/24; B65D 5/22; B65D 5/422; B65D 5/542
USPC ..... 206/767
See application file for complete search history.

(56) References Cited

U.S. PATENT DOCUMENTS 1,860,309 A * 5/1932 Davidson ..... B65D 5/5206 206/45.21
2,259,041 A * 10/1941 Larkin ..... B65D 5/52 206/766
3,167,179 A * 1/1965 Goldstein ..... B65D 73/00 206/763
4,138,012 A 2/1979 Dutcher et al.
4,350,281 A 9/1982 Dornbusch et al.
6,109,514 A * 8/2000 Otis ..... B65D 5/4225 206/459.5
6,341,755 B1 1/2002 Kump
(Continued)

FOREIGN PATENT DOCUMENTS

DE 3438721 4/1986
DE 102007041253 3/2008
(Continued)

*Primary Examiner* — King M Chu
(74) *Attorney, Agent, or Firm* — Myron Greenspan; Lackenbach Siegel LLP

(57) ABSTRACT

A cut-case with enhanced display of product information includes a product container having a front wall forming a surface area facing a viewing direction when on a store shelf. A lid at least partially receives the product container to close an open top to make the cut-case suitable and the products contained for shipment therein. A display panel is hingedly connected to the front wall for pivoting movements between a retracted position during shipment and storage substantially co-extensive with one of the product container walls and an extended position substantially co-planar with the front wall and extending below the bottom wall when placed on a store shelf to at least partially cover the shelf on which the product container is placed. The front wall retains products within the container and product information is provided on the display panel over a surface area greater than the surface area of the front wall.

18 Claims, 8 Drawing Sheets

(56) References Cited

U.S. PATENT DOCUMENTS

| | | | |
|---|---|---|---|
| 6,811,044 | B2 | 11/2004 | Walker |
| 7,487,611 | B2 | 2/2009 | Robb |

FOREIGN PATENT DOCUMENTS

| | | |
|---|---|---|
| JP | 3159608 | 2/1996 |
| JP | 2000134007 | 5/2000 |
| JP | 2006158761 | 6/2006 |
| JP | 2007061194 | 3/2007 |
| JP | 2009183348 | 8/2009 |
| JP | 5317727 | 8/2010 |
| JP | 2010172507 | 8/2010 |

* cited by examiner

CUT-CASE WITH ENHANCED DISPLAY OF PRODUCT INFORMATION

BACKGROUND OF THE INVENTION

1. Field of the Invention

The invention generally relates to containers for shipping and displaying products and, more specifically, to a cut-case with enhanced display of product information.

2. Description of the Prior Art

Manufacturers of products, particularly those sold at retail to consumers, typically have two concerns insofar as product packaging. The first is that the cases or containers in which the products are shipped must securely house and protect the products during shipment. The second is to insure that the products are properly displayed and promoted when products arrive in retail establishments. This includes the desire to maximize the information or exposure of the products to consumers to get their attention and provide them important or relevant information to interest them in looking at and, hopefully, purchasing the product. Such containers are typically known as "cut-case" displays. These are cases and methods of merchandising and stocking products that use the original packing case for shipment, with the top and/or sides of the case removed to display the products on store shelves.

In an effort to provide the aforementioned functionalities multiple cut-cases and other designs have been proposed. Displays with enhancing panels/devices have been designed to cover at least part of a shelf on which the cut-case is supported. For example, display enhancing panels/devices have been proposed that are mountable on the shelf front edge. Patent No. DE102007041253A1 discloses a slipcase for holding magazines and the like that has a tongue that drops down with a portion thereof exposed on the top surface of the shelf in which the slip case is supported or on the leading edge of the shelf as viewed by observers, the area for providing additional information is very limited. Additionally, once the tongue is in its operative position there is nothing to prevent the contents of the slip case to keep the contents within the slip case during display. This may not be an issue for magazines or brochures it could very much be an issue for larger three dimensional objects that are housed within the slip case. The slipcase comprises of a promotional panel/tongue that is dropped in front of the underside of the slipcase. The promotional panel is fixable to the shelf leading edge.

Patent references (such as U.S. Pat. No. 6,811,044 B2, U.S. Pat. No. 6,341,755 B I) disclose a shelf adaptor. Shelf adaptors are mountable on the edges of shelves and support the products meant for display. Shelf adaptors include a promotional panel that drop in front of a shelf. The promotional panel displays price and product information.

Japanese patent JP3159608U discloses a display device for promoting a book. The device comprises of a pair of card holders that display information about the book. The device is able to support the books. The device is mountable on the shelf with one of the promotional card holders dropping in front of the shelf.

Other references (such as JPI-107:2329B2, US748761 I B2, JP2007061194A, JP5317727B2 and DE343872IA 1) disclose a device for promoting goods displayed on a shelf. The device is mountable on the shelf. The device displays product information and price details. References JPH071232982 and JP5317727B2 further disclose separate slots for displaying a price card. Other references (JP2006158761 A and JP3173596U) disclose a product advertisement display device. The device fits on display shelves. The display shelves are in a drop-down shape for accommodating the display device. Additional references U.S. Pat. No. 4,138,012 A and JP2009183348A disclose display devices that, display products. The display panels are placed at the bottom of the item storage area.

U.S. Pat. No. 4,350,281 discloses a one piece shipping container with cut-case protection. However, once the top cover or sleeve is removed the front wall of the remaining container provides a very limited surface area for displaying information about the contents of the products displayed within the case.

SUMMARY OF THE INVENTION

Accordingly, it is an object of the invention to provide a cut-case with enhanced display of product information when on a store shelf.

It is another object of the invention to provide a cut-case that is simple in construction and economical to manufacture.

It is still another object of the invention to provide a cut-case that is easy to use and implement when placed on display on a retail shelf.

It is yet another object of the invention to provide a cut-case as in the above objects that safely stores products during shipment and retains products within the cut-case during display by preventing product from inadvertently spilling out of the case and off a shelf when on display.

It is a further object of the invention to provide a cut-case as in the aforementioned objects that significantly increases the display surface area for advertising, product information and the like.

It is still a further object of the invention to provide a cut-case as aforementioned that includes retainers for retaining a display panel in its totally operative extended displaying position.

It is yet a further object of the invention to provide a cut-case as in the previous objects that includes a cutout notch or cutout portion on the display panel to expose a price sticker or label on the edge of a retail store shelf while the display panel in its extended position covers a remaining portion of a shelf in the proximity of the cut-case.

In order to achieve the above and other objects that will become evident hereinafter, a cut-case in accordance with the invention with enhanced display of product information comprises a product container having a bottom wall, spaced side walls, spaced rear and front walls and an open top together forming a space for displaying products within said space when said product container is placed on a store shelf. Said front wall has a predetermined surface area facing a direction for viewing when on a store shelf A lid is dimensioned to at least partially receive said product container to close said open top to make the cut-case suitable for shipping and/or storage of said product container and the products contained therein. A display panel is provided for movements relative to the front wall to a position substantially co-planar with said front wall, when the cut-case displays products on a shelf, to extend below said bottom wall to at least partially cover the shelf on which said product container is placed. Said front wall retains products within said container while product information is provided over a surface area greater than said predetermined surface area of said front wall.

BRIEF DESCRIPTION OF THE DRAWINGS

The above and other aspects, features and advantages of the present invention will be more apparent from the following description when taken in conjunction with the accompanying drawings, in which.

DESCRIPTION OF PREFERRED EMBODIMENTS

Figure 1:
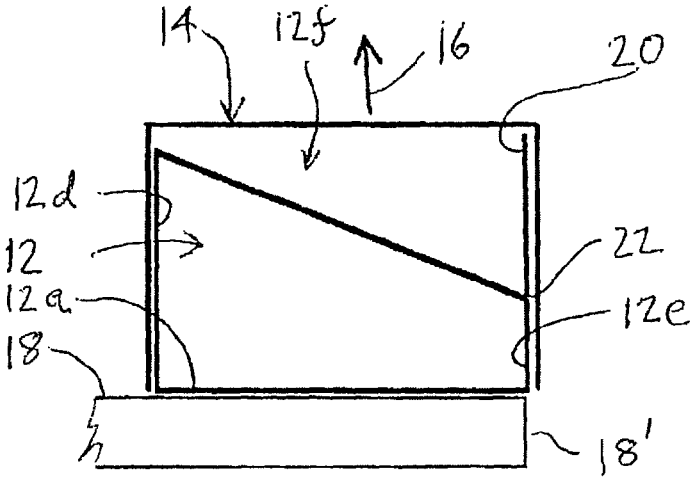
FIG. 1 is a diagrammatic representation of a cut-case in accordance with the invention, showing in cross-section the product container and the lid or cover when assembled for shipment or storage.

Referring now to the figures, in which the identical or similar parts are designated by the same reference numerals throughout, and first referring to FIG. 1, one embodiment of a cut-case with enhanced display of product information in accordance with the invention is generally designated by the reference numeral 10.

The cut-case 10 includes a product container 12 having a bottom wall 12*a*, spaced side walls 12*b*, 12*c* spaced rear and front walls 12*d*, 12*c*, respectively and an open top 12*f* together forming a space for displaying products within the case when the product container 12 is placed on a store shelf.

The front wall 12*e* forms a predetermined surface area S1 normally visible for viewing when on a store shelf.

A cover or lid 14 is provided for partially receiving the product container 12 to close the open top 12*f* to render the cut-case suitable for shipping and/or storage of the product container and the products contained therein.

Figure 2:
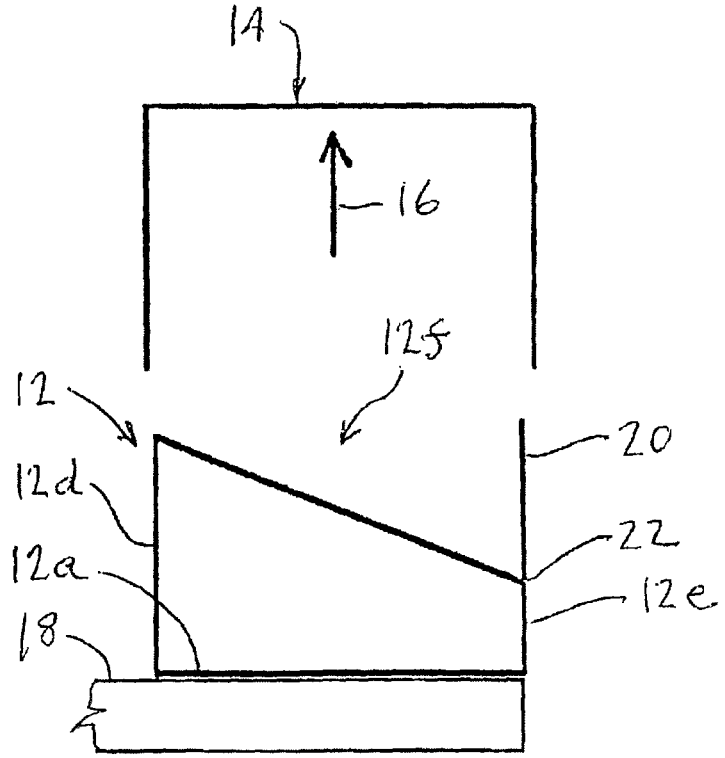
FIG. 2 is similar to FIG. 1, shown with the lid or cover removed from the product container, the display panel in a container being substantially in a co-extensive position with the front wall of the product container.

To be displayed in a retail store, the cover or lid 14 is raised, as indicated by arrows 16 in FIGS. 1 and 2, to expose the open top 12*f* and the products within the container 12 when placed on a store shelf 18.

Frequently, the rear wall 12*d* of a cut-case has a height greater than the height of the front wall 12*e* in order to better exhibit or display the products within the container. However, in the cut-case 10 the height of the rear wall 12*d* is approximately equal to the sum of the heights of the front wall 12*e* and the height of an upper display panel 20 attached to the front wall 12*e*. The display panel 20 is hingedly connected to the front wall 12*e* for pivoting movements between a retracted position shown in FIGS. 1 and 2. During shipment the display panel 20 is substantially co-planar with the front wall 12*e* and an extended position substantially co-extensive with the fixed front wall 12*e* to preferably extend below the bottom wall 12*a* when placed on a store shelf 18 to at least partially cover the shelf on which the product container is placed. In this manner, the front wall 12*e* serves to retain products within the product container 12 to prevent product from inadvertently falling out of the product container and off the shelf 18 while the display panel 20*a* provides an enhanced surface area S2 (FIGS. 4 and 6) for displaying information over a surface area greater than the surface area S1 provided by the front wall 12*e* (FIG. 5).

Figure 3:
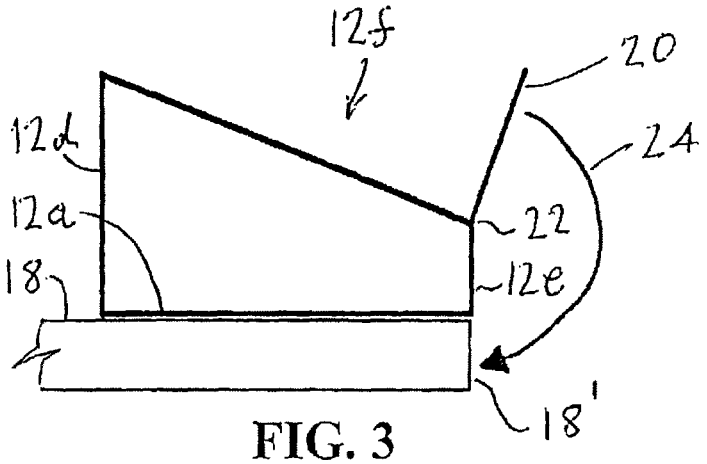
FIG. 3 is similar to FIG. 2 and shows the display panel pivoted or folded about a hinge from the position shown in FIG. 2.
Figure 4:
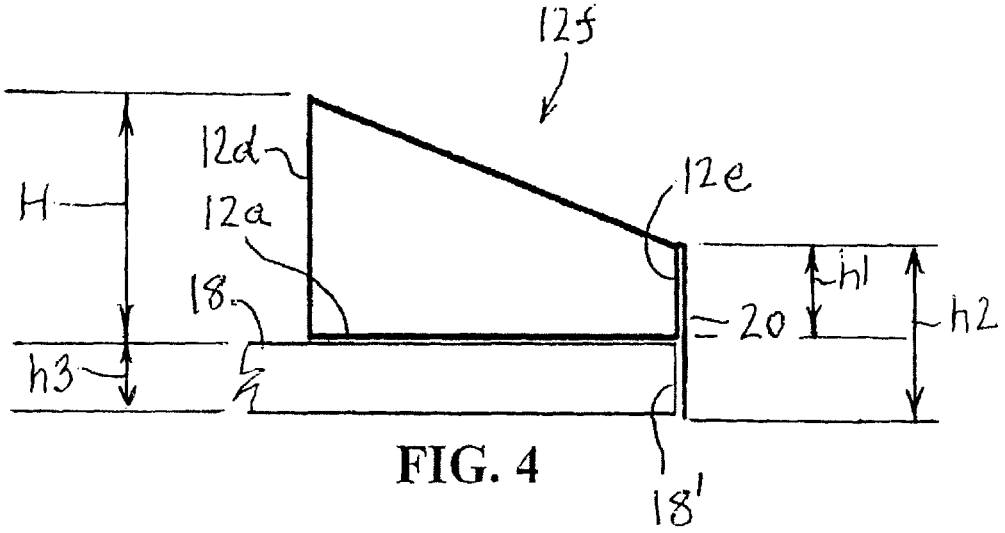
FIG. 4 is similar to FIG. 3 with the display panel pivoted 180 degrees from its initial position shown in FIGS. 1 and 2 and extended to its operative position.
Figure 5:
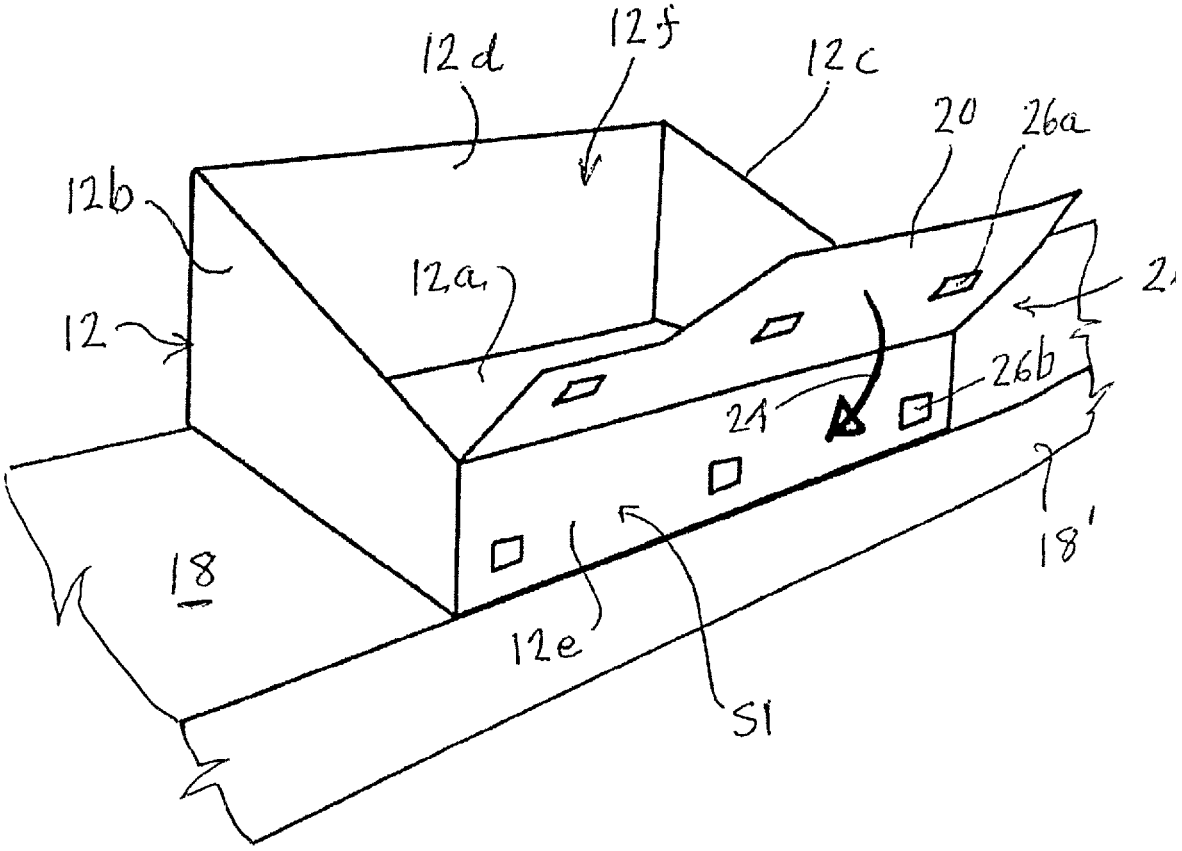
FIG. 5 is a perspective view substantially corresponding to FIG. 3.
Figure 6:
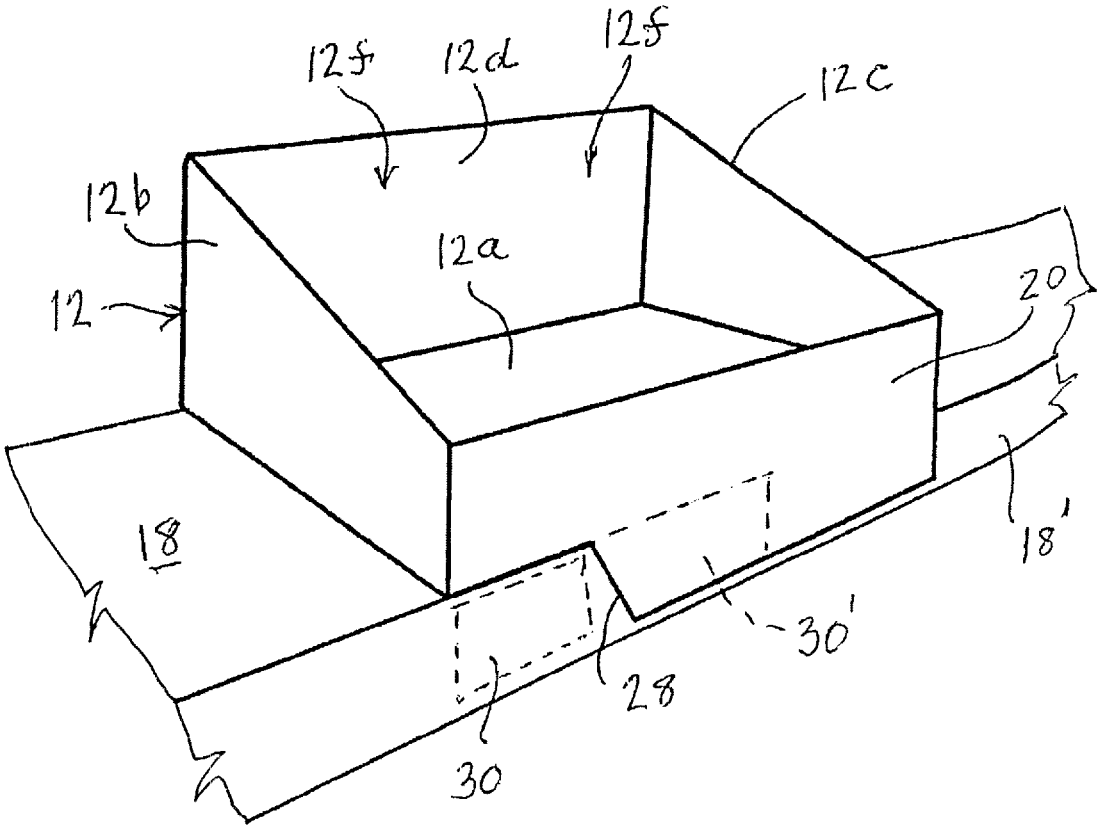
FIG. 6 is a perspective view substantially corresponding to FIG. 4.

A hinge 22 is provided between the upper display panel 20 and the front wall 12*e* to readily facilitate the panel 20 to be pivoted or folded from the position shown in FIGS. 1 and 2 to the display or operative position shown in FIGS. 4 and 6, as suggested by the arrow 24 in FIG. 3. The specific hinge 22 used is not critical and may be a plastic hinge, a fold line about which a corrugated cardboard can be folded or a weakened line by an indentation or partial cut line just above the front wall 12*e*. The hinge 22 should be adequate to allow the display panel 20 to move from a position generally co-planar with the front wall 12*e* when the product container 12 is covered by the cover or lid 14 to a 180 degree pivoted position substantially after the 12 lid is removed in order to at least partially cover the shelf 18 on which the product container is placed.

Referring to FIG. 2, where the front wall 12*e* has a height h1 above the bottom wall 12*a* and the display panel 20 has a height h2 above the bottom wall 12*e*, co-planar with the front wall, h2 is selected to be greater than h1 to at least cover and preferably extend below the shelf 18 when pivoted from the retracted to the extended positions shown in FIG. 4 to cover the front wall 12*e*. The height or thickness of the shelf 18 is h3 and the invention allows h2 to be approximately equal to or greater than h1+h3. When the height of the cut-case is H (FIG. 2), H is approximately equal to h1+h2.

The material of which the cut-case 10 is formed is not critical and can be corrugated cardboard, laminated plastic or any other suitable or conventional material used for cut-cases.

Referring to FIG. 5, the cut-case container 12 includes a locking mechanism for securing and maintaining the display panel 20 in the extended position when pivoted over the front wall 12*e* as suggested in FIG. 5. Such securing means may be any conventional means for maintaining the display panel in its display position shown in FIG. 6 and may include magnet pairs or hook and loop fasteners on the surfaces of the display panel and the front wall arranged to register when the display panel 20 is moved to its extended position.

Another feature of the invention is the provision of a notched or cut-out portion 28 to leave exposed a portion of the shelf 18 when the display panel 20 is moved to the extended position, as shown in FIG. 6 to expose a price sticker or label 30 on an edge 18' of the shelf 18 proximate to the location of the cut-case when the display panel is in its extended or operative position. The notched cut-out portion can be made large or small and positioned anywhere along display panel to accommodate or conform to the location(s) of a retailer's price labels or stickers on the edge of a shelf.

Figure 7:
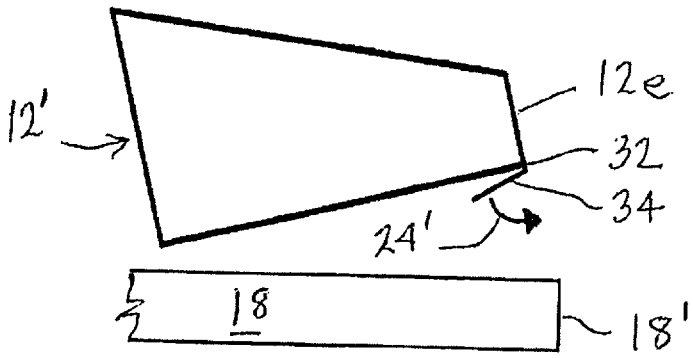
FIG. 7 is similar to FIG. 2 but showing an alternate embodiment in which the display panel is initially co-extensive with the bottom wall of the cut-case.
Figure 8:
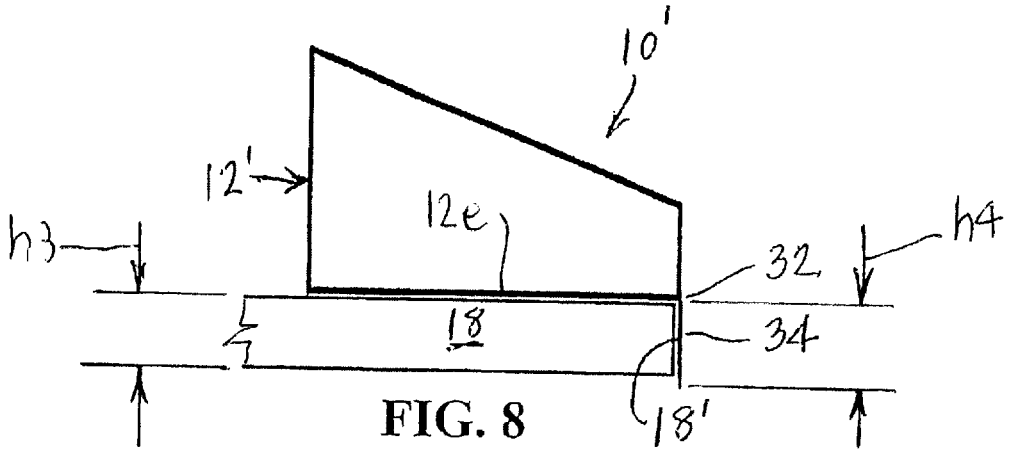
FIG. 8 is similar to FIG. 4, showing the display panel of FIG. 7 in its extended and operative display position.
Figure 9:
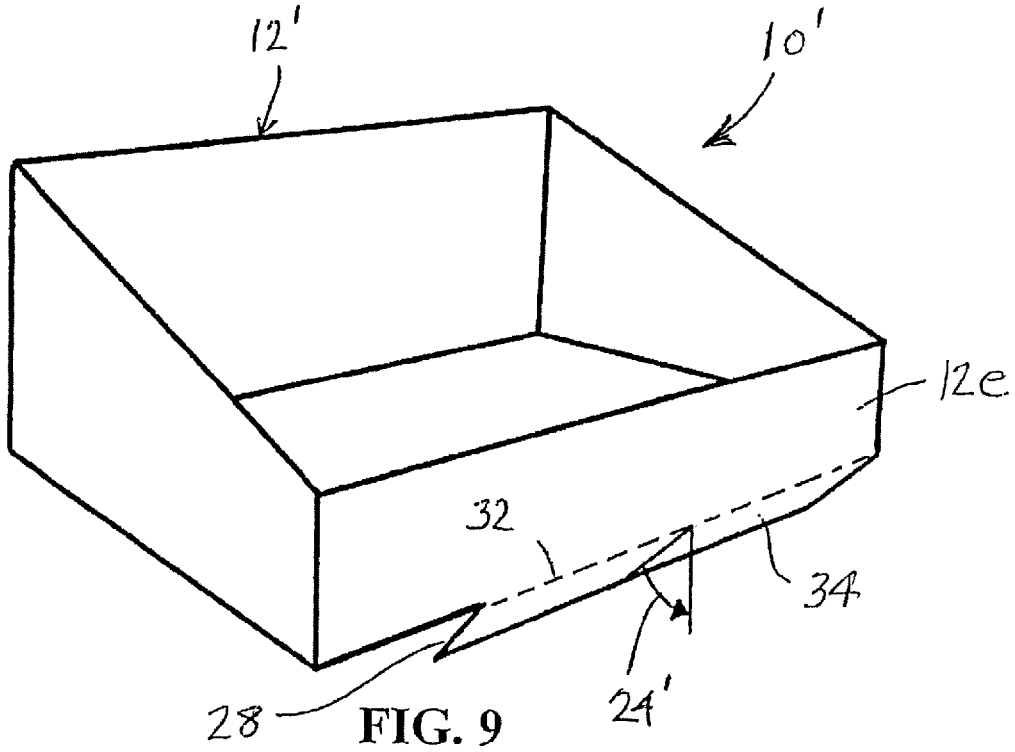
FIG. 9 is a perspective view substantially corresponding to the view shown in FIG. 7.
Figure 10:
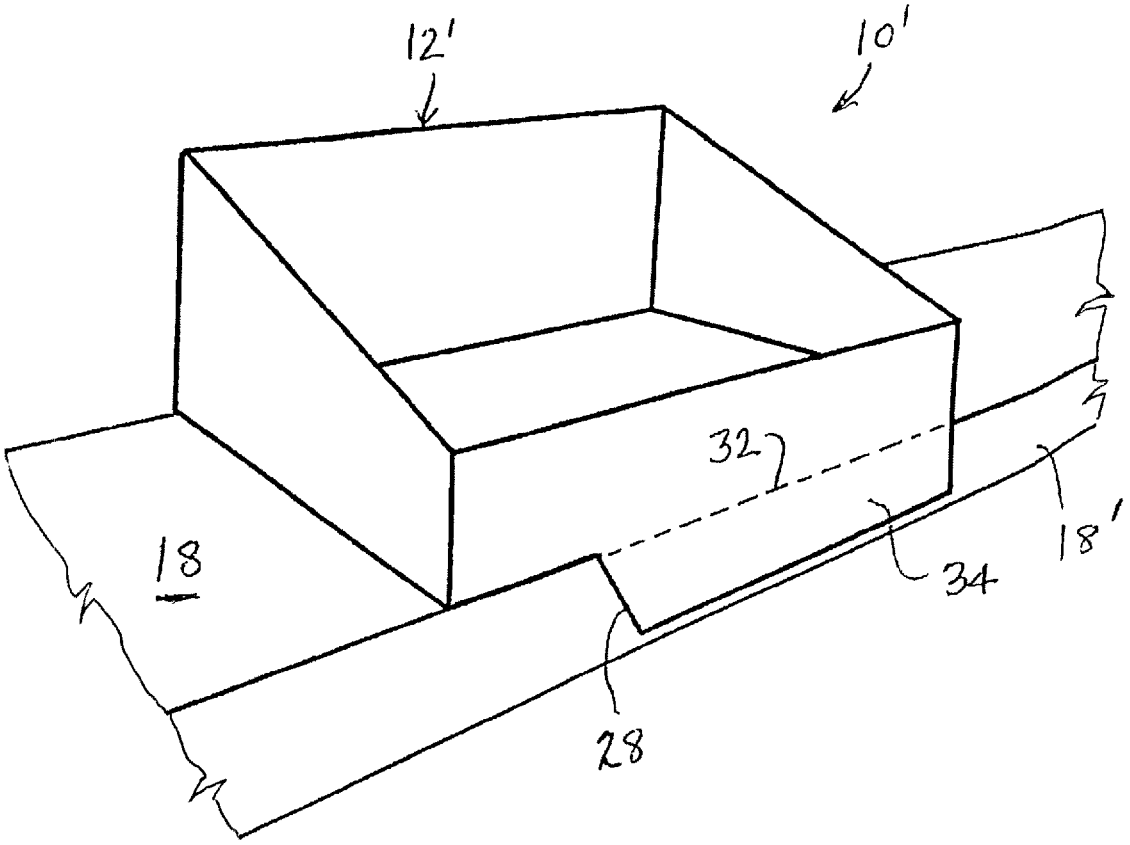
FIG. 10 is a perspective view substantially corresponding to FIG. 8.

Referring to FIGS. 7-10, another embodiment 10' in accordance with the invention is shown in which the front wall 12*e* has a lower edge or hinge 32 to which a display panel 34 is connected as shown in FIG. 7. The display panel 34 is initially arranged coextensively with the bottom wall 12*a* prior to being displayed when pivoted 90 degrees (arrow 24) to its extended position as shown in FIGS. 8 and 10 to at least partially cover the shelf 18 on which the product container is placed. In this embodiment, the height or thickness of the shelf h3 is covered by the display panel 34 having a height of h4 below the front wall 12*e* in its extended position and h4 is approximately equal to or greater than h3.

In this embodiment, since the panel is not protected by the cover or lid 14 during shipment any suitable form of fastener or retainer for protecting the display panel 34 during shipment or storage by maintaining it attached to the bottom wall 12*a* in its retracted position. Such securing means can comprise adhesive tape, hook and loop fasteners etc. that can be readily removed in order to pivot or fold the display panel 34 to its extended or operative positions shown in FIGS. 8 and 10.

As with the previous embodiment, the cut-case 10' may also advantageously be provided with a notch or cut out portion 28 to display a store price sticker or label typically applied to the edge 18' of a shelf proximate to the location of the cut-case so that it can be viewed even when the display panel 34 covers all or most of the rest of the adjacent edge surface of the shelf 18.

Figure 11:
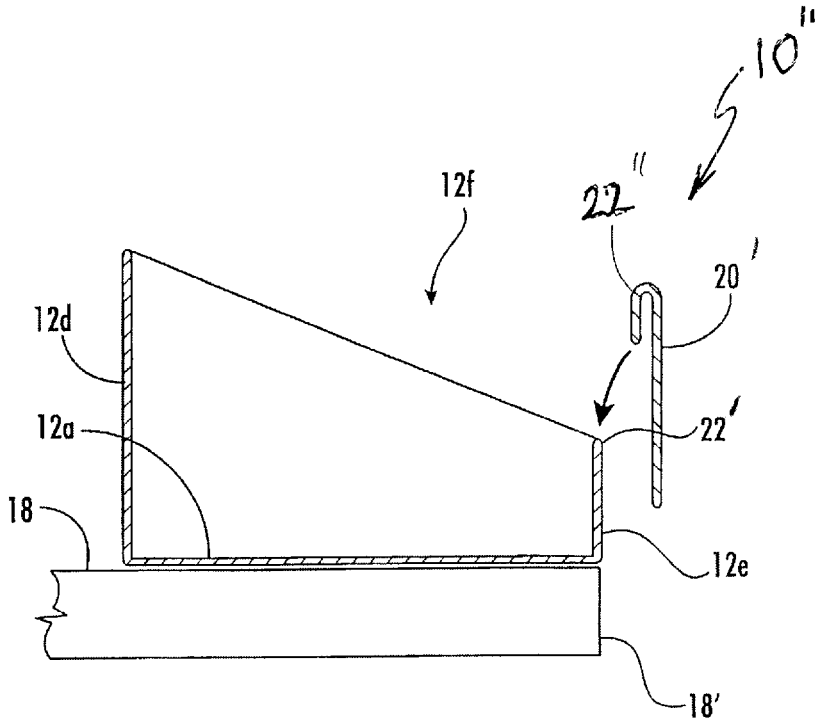
FIG. 11 is a cross sectional view of a further alternate embodiment in which the display panel is not integrally formed with the cut case but is a separate panel attachable to the front wall.
Figure 12:
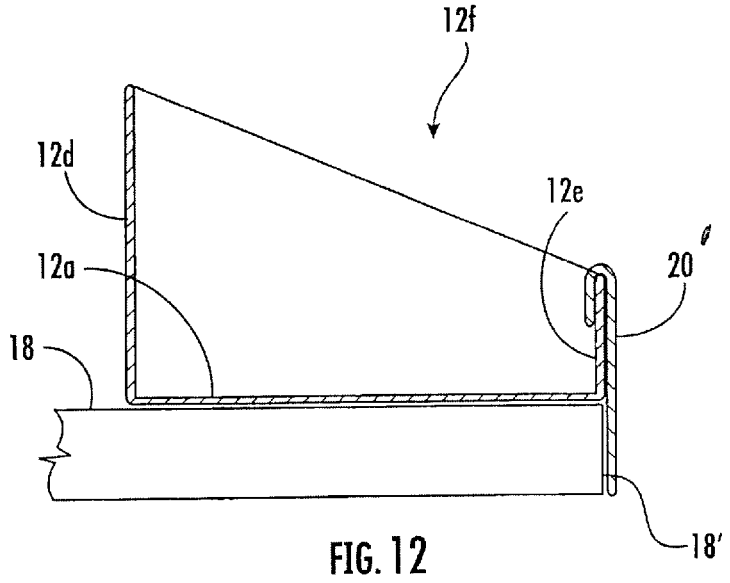
FIG. 12 shows the display panel of FIG. 11 secured to the front wall overlapping the front edge of the shelf.
Figure 13:
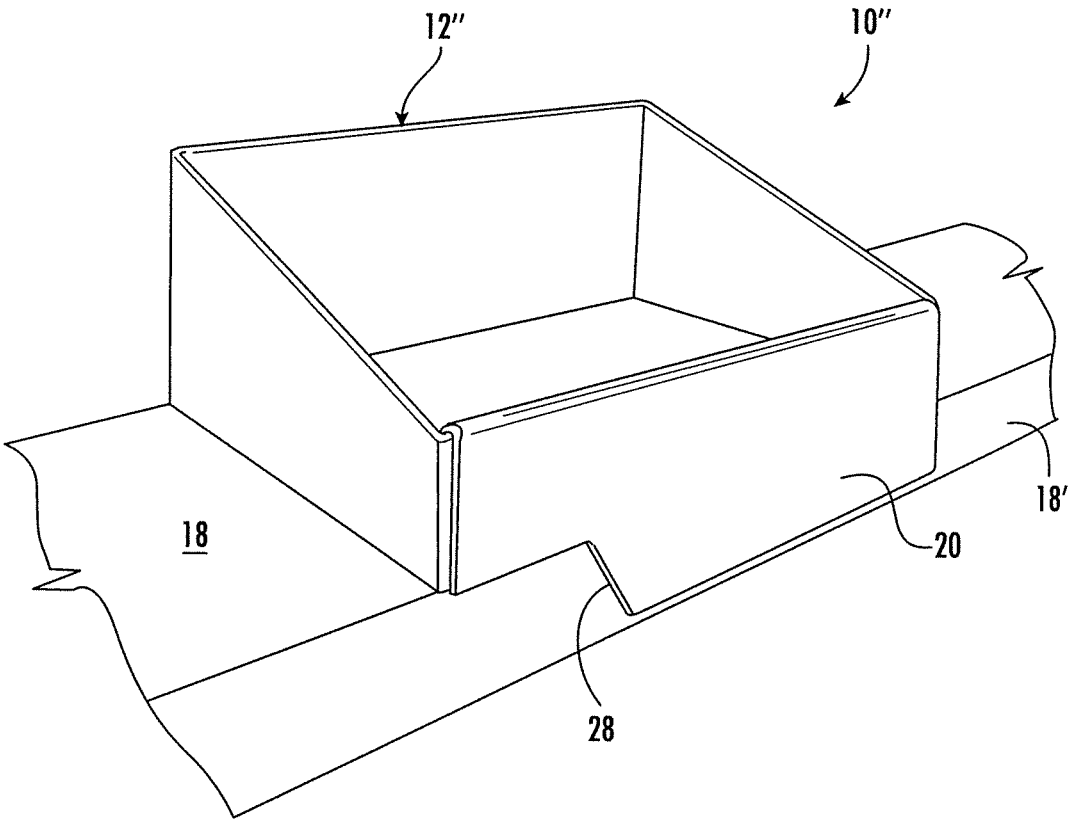
FIG. 13 is similar to FIGS. 6 and 10 for the embodiment shown in FIGS. 11 and 12.

A still further embodiment 10" of the invention is illustrated in FIGS. 11-13. In this embodiment display panel 20' is not initially secured or integrally formed with the container. Instead, the display panel 20' is initially a separate piece or member that includes an inverted U-shaped cross section 22" configured and dimensioned to be slipped over the upper edge of the front wall 12*e* as shown in FIGS. 12 and 13. The display panel 20' can, for purposes of shipment or storage, be stored within the case and removed for placement over the front wall 12*e* as shown when the case is placed on a shelf for display.

In an alternative embodiment the display panel does not have the inverted U-shaped configuration along the top edge, in which case any other attachment mechanism can be used, such as mating hook-and-loop fasteners, double sided tape, peel-off adhesive, etc, to secure the display panel to the front surface of the front wall 12*e*.

The present invention, therefore, contemplates different forms or embodiments for securing a display panel with an enlarged or enhanced display surface area in front of a front wall of a cut case. The specific manner in which a display panel is stored or maintained during shipment and storage is not critical for purposes of the present invention. It is only important that the enhanced or enlarged display panel be shipped with the cut-case and is attachable to or pivotable relative to the front wall to cover the front surface of the front wall and at least partially overlap the front edge of a shelf on which the cut case is supported. The display panel in each of the above embodiments extends to the bottom edge of a shelf. However, this is not critical and the height of the display panel can be smaller or larger than what is shown to partially expose the shelf, totally cover the front edge of the shelf or extend below the shelf.

As it will be evident, the subject invention provides a greater or enhanced surface area to provide additional product information to promote the product to increase sales without compromising simplicity, cost of manufacturing or the display of products within the case and without requiring additional, auxiliary or stand alone panels or attachments that need to be secured to a shelf as has been done with other display devices.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A cut-case with enhanced display of product information when placed on a store shelf comprising a product container having a bottom wall, spaced side walls, spaced rear and front walls and an open top wall together forming a space for displaying products within said space when said product container is placed on a store shelf, said front wall defining a surface area facing a direction for viewing when on a store shelf; a lid dimensioned to at least partially receive said product container to close said open top to make the cut-case suitable for shipping and/or storage of said product container; and a display panel arranged for movement from a storage position relative to said front wall to an operative position substantially co-planar with said front wall and extending below said bottom wall when placed on a store shelf to at least partially cover the shelf on which said product container is placed, whereby said front wall retains products within said container and product information is provided over a surface area greater than said surface area of said front wall.

2. A cut-case as defined in claim 1, wherein said front wall has an upper edge and said display panel is hingedly connected to said upper edge.

3. A cut-case as defined in claim 2, wherein said display panel is generally co-planar with said front wall when said product container is covered by said lid and is arranged to pivot 180 degrees, after said lid is removed, to at least partially cover the shelf on which said product container is placed.

4. A cut-case as defined in claim 3, wherein said front wall has a height "h1" above said bottom wall and said display panel has a height "h2" above said front wall when co-planar with said front wall, "h2" being greater than "h1" to at least extend below said bottom wall when pivoted from said co-planar to said extended positions to cover said front wall.

5. A cut-case as defined in claim 4, wherein the height of said cut-case is H and H≈h1±h2.

6. A cut-case as defined in claim 2, further comprising securing means for securing said display panel in said operative position when pivoted over said front wall.

7. A cut-case as defined in claim 6, wherein said securing means comprises mating hook and loop fasteners on said display and front wall arranged to register when said display panel is moved to said operative position.

8. A cut-case as defined in claim 1, wherein said display panel is provided with a notched or cut-out portion to leave exposed a portion of the shelf when said display panel is in said operative position, whereby a price sticker or label on an edge of the shelf proximate to the location of the cut-case can be viewed.

9. A cut-case as defined in claim 1, wherein said front wall has a lower edge and said display panel is hingedly connected to said lower edge.

10. A cut-case as defined in claim 9, wherein said display panel is initially arranged generally coextensively with said bottom wall in a storage position or during shipment and prior to being displayed and is arranged to pivot 90 degrees to said operative position to at least partially cover a shelf on which said product container is placed.

11. A cut-case as defined in claim 10, wherein said display panel has a height "h4" below said front wall in its operative position.

12. A cut-case as defined in claim 10, further comprising securing means for securing said display panel to said bottom wall in said operative position.

13. A cut-case as defined in claim 12, wherein said securing means comprises adhesive tape.

14. A cut-case as defined in claim 9, wherein said display panel is provided with a notched or cut out portion to leave exposed a portion of the shelf when said display panel is in its operative position, whereby a price sticker or label on an edge of the shelf proximate o the location of the cut-case can be viewed.

15. A cut-case as defined in claim 1, wherein said front wall has a height less than a height of said rear wall.

16. A cut-case as defined in claim 1, wherein said display panel is integrally formed with said product container.

17. A cut-case as defined in claim 1, wherein said display panel is normally a separate or stand alone member.

18. A cut-case as defined in claim 17, wherein said display panel comprises a generally flat member having a height greater than the height of said front wall and provided with an inverted U-shaped cross-section along one edge configured to slip over said top edge of said front wall to be supported by said front wall.

* * * * *